United States Patent [19]

Sasaki

[11] Patent Number: 5,070,739

[45] Date of Patent: Dec. 10, 1991

[54] KICK STARTING APPARATUS FOR MOTORCYCLE

[75] Inventor: Mitsuyuki Sasaki, Hamamatsu, Japan

[73] Assignee: Suzuki Jidosha Kogyo Kabushiki Kaisha, Japan

[21] Appl. No.: 449,583

[22] Filed: Dec. 11, 1989

[30] Foreign Application Priority Data

Dec. 19, 1988 [JP] Japan ..... 63-163445[U]

[51] Int. Cl.[5] ..... F02N 3/04

[52] U.S. Cl. ..... 74/6

[58] Field of Search ..... 74/6; 123/179 SE, 185 C, 123/185 CA

[56] References Cited

U.S. PATENT DOCUMENTS 2,644,439 7/1953 Behringer ..... 123/185 CA
2,841,990 7/1958 Hilber ..... 74/6

FOREIGN PATENT DOCUMENTS 55-75567 6/1980 Japan ..... 74/6
737717 9/1955 United Kingdom ..... 123/185 CA
853377 11/1960 United Kingdom ..... 123/185 C

*Primary Examiner*—Allan D. Herrmann

*Attorney, Agent, or Firm*—Bruce L. Adams; Van C. Wilks

[57] ABSTRACT

A kick starting apparatus for a motorcycle comprises a kick lever for starting a kick operation, a kick shaft rotatably mounted to a crank case and a clutch case of the motorcycle when they are mated, a kick drive gear mounted to the kick shaft, a kick idle gear mated with the kick drive gear and rotatably connected to a drive shaft of a power transmission system of the motorcycle, and a kick shaft return spring elastically mounted to the kick shaft. The crank case is provided with an attachment boss disposed inside and near the mating face of the crank case and the boss is provided with a hole extending substantially in parallel to the kick shaft. The kick shaft return spring has a main body accommodated in the clutch case when mated with the crank case, a free end bent firmly engaged with the kick shaft, and a stationary end to be inserted into the hole formed in the attachment boss with a right angle so as to extend in parallel to the kick shaft. The clutch case is provided with a boss-shaped stopper portion corresponding to the attachment boss of the crank case when they are mated with each other for preventing the kick shaft return spring from falling out from the hole.

7 Claims, 3 Drawing Sheets

KICK STARTING APPARATUS FOR MOTORCYCLE

BACKGROUND OF THE INVENTION

This invention relates to a kick starting apparatus for a motorcycle for driving a crank shaft in response to the rotation of a kick shaft driven by a kick operation.

A motorcycle includes a power transmission system generally comprising a crank shaft, a primary drive gear operatively connected to the crank shaft, a primary driven gear engaged with the primary drive gear, a clutch, a counter shaft operatively connected to the clutch, a transmission drive gear train, a drive shaft engaged with the transmission drive gear train, a drive sprocket gear mounted to the drive shaft, and a chain connected to the drive sprocket gear.

A kick starting system is arranged in connection with the power transmission system of the structure described above. The kick starting system comprises a kick shaft rotated by a kick lever, and a kick drive gear is mounted on the kick shaft to be rotatable. The kick drive gear is always engaged with a kick idle gear which is mounted at one end thereof on the drive shaft of the power transmission system to be rotatable.

A dog piece is mounted on the kick shaft by way of a helical spline and a dog is mounted on the side surface of the dog piece. This dog is positioned at a portion corresponding to the location of another dog mounted on the side surface of the kick drive gear. The rotation of the kick shaft causes the helical spline to displace on the kick shaft and engage the dogs with each other. In the engaged state, the kick shaft is rotated together with the dog piece and the kick drive gear.

In response to the rotation of the kick drive gear, the crank shaft is driven through the engagement of the kick idle gear, the kick driven gear engaged with the primary driven gear, the primary drive gear, and, hence, the crank shaft.

After the driving of the crank shaft, the rotation of the crank shaft is transmitted to the kick drive gear, which is then overrun, and the dog piece is thereby returned to separate the dogs from each other, whereby the kick shaft is released and returns.

Around the kick shaft is mounted a kick shaft return spring in the form of a coil spring. The inner free end of the return spring is engaged with the kick shaft and the outer stationary end thereof is engaged with a stopper bolt screwed with a threaded hole of the crank case.

With the kick starting system of the motorcycle of the construction described above, the stationary end of the kick shaft return spring is secured to the crank case through the stopper bolt which is screwed with the threaded hole of the crank case. The usage of such a stopper bolt requires a space for location and involves manufacturing cost thereof as well as the increasing numbers of the members to be assembled.

SUMMARY OF THE INVENTION

An object of this invention is to substantially eliminate the defects and drawbacks encountered in the prior art described above and to provide a kick starting apparatus for a motorcycle having an improved kick shaft return spring capable of easily and firmly engaging with a crank case without utilizing any specific fastening means such as fastening bolt, thus reducing the inner space of the crank case and making compact the system with reduced cost.

This and other objects can be achieved according to this invention by providing a kick starting apparatus for a motorcycle of the type comprising a kick lever for starting a kick operation, a kick shaft rotatably mounted to a crank case and a clutch case of the motorcycle when they are mated with a gasket interposed therebetween, a kick drive gear mounted to the kick shaft, a kick idle gear mated with the kick drive gear and rotatably connected to a drive shaft of a power transmission system of the motorcycle, and a kick shaft return spring elastically mounted to the kick shaft, the crank case having an end mating face to be mated with an end mating face of the clutch case, the crank case being provided with an attachment boss disposed inside and near the mating face of the crank case, the boss being provided with a hole extending substantially in parallel to the kick shaft and the kick shaft return spring having a main body accommodated in the clutch case when mated with the crank case, a free end firmly engaged with the kick shaft and a stationary end to be inserted into the hole formed in the attachment boss.

In preferred embodiments, the stationary end of the kick shaft return spring is bent at a substantially right angle with respect to the main body thereof so as to extend in parallel to the kick shaft. The clutch case is provided with a boss-shaped stopper portion corresponding to the attachment boss of the crank case when they are mated with each other for preventing the kick shaft return spring from falling out from the hole. The attachment boss is provided with an end surface positioned slightly inward from the mating face of the crank case.

According to the kick starting apparatus of the character described above, the stationary end of the kick shaft return spring is inserted into and secured to the engaging hole formed in the attachment boss of the crank case when the crank case and the clutch case are mated with each other. After the mating, the kick shaft return spring is prevented from falling out from the hole during the operation thereof by the location of the stopper portion formed to the clutch case. The end surface of the attachment boss is positioned slightly inward from the mating face of the crank case, so that the mating face is never damaged by the stationary end of the kick shaft return spring when inserted into the hole.

DESCRIPTION OF THE PREFERRED EMBODIMENTS

For a better understanding of this invention, a conventional kick starting system of a motorcycle will be first described with reference to FIGS. 5 and 6.

Figure 5:
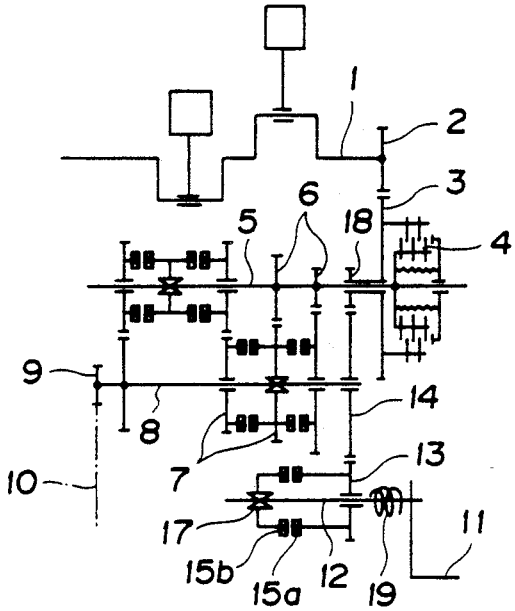
FIG. 5 is a block diagram showing a power transmission system of a motorcycle to be operatively connected to the kick starting system.

FIG. 5 shows a block of a power transmission system of a motorcycle generally comprising a crank shaft 1, a primary drive gear 2 operatively connected to the crank shaft, a primary driven gear 3 engaged with the primary drive gear, a clutch 4, a counter shaft 5 operatively connected to the clutch, a transmission drive gear train 7, a drive shaft 8 engaged with the transmission drive gear train, a drive sprocket gear 9 mounted to the drive shaft, and a chain 10 connected to the drive sprocket gear.

Figure 6:
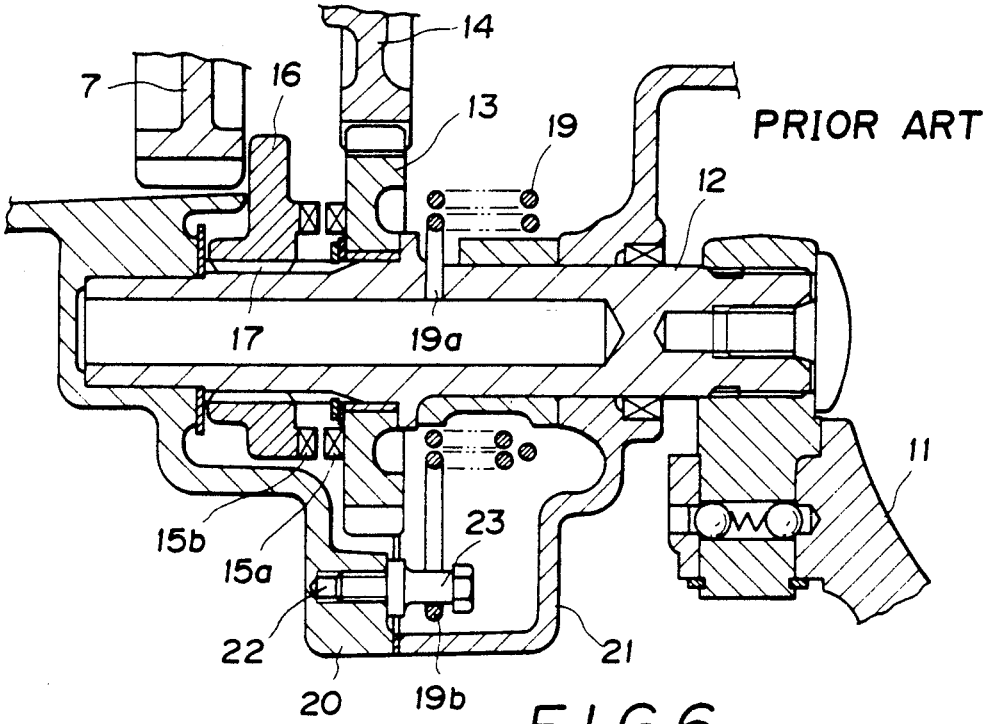
FIG. 6 is a side elevational section of the kick starting system of a conventional type.

A kick starting system shown in FIG. 6 is arranged in connection with the power transmission system of the structure shown in FIG. 5. The kick starting system comprises a kick shaft 12 rotated by a kick lever 11 and a kick drive gear 13 mounted on the kick shaft to be rotatable. The kick drive gear 13 is always engaged with a kick idle gear 14 which is mounted on the drive shaft at one end thereof of the power transmission system to be rotatable.

A dog piece 16 is mounted on the kick shaft by way of a helical spline 17, and a dog **15*b* is mounted on the side surface of the dog piece 16. This dog 15*b* is positioned at a portion corresponding to the location of another dog 15*a* mounted on the side surface of the kick drive gear. The rotation of the kick shaft 12 causes the helical spline 17 to displace on the kick shaft and engage the dogs with each other. In the engaged state, the kick shaft 12** is rotated together with the dog piece and the kick drive gear.

In response to the rotation of the kick drive gear 13, the crank shaft is driven through the engagement of the kick idle gear 14, the kick driven gear 18 engaged with the primary driven gear 3, the primary drive gear 2, and, hence, the crank shaft 1.

After the driving of the crank shaft 1, the rotation of the crank shaft is transmitted to the kick drive gear 13, which is then overrun, and the dog piece 16 is thereby returned to separate the dogs **15*a* and 15*b* from each other, whereby the kick shaft 12** is released and returns.

Around the kick shaft 12 is mounted a kick shaft return spring 19 in the form of a coil spring The inner free end **19*a* of the return spring is engaged with the kick shaft 12 and the outer stationary end 19*b*thereof is engaged into a stopper bolt 23 screwed with a threaded hole 22 of the crank case 20**.

To the crank case 20 is coupled a clutch case 21 and the kick shaft 12 is mounted to the crank case 20 and the clutch case 21 in a bridging manner.

With the kick starting system of the character described above, the kick shaft return spring 19 has the defects described hereinbefore.

A kick starting apparatus for a motorcycle according to this invention was conceived to eliminate these defects encountered to the prior art. An embodiment of the kick starting system of this invention will be described hereunder with reference to FIGS. 1 to 4, in which like reference numerals are added to elements or members corresponding to those shown in FIGS. 5 and 6.

Figure 1:
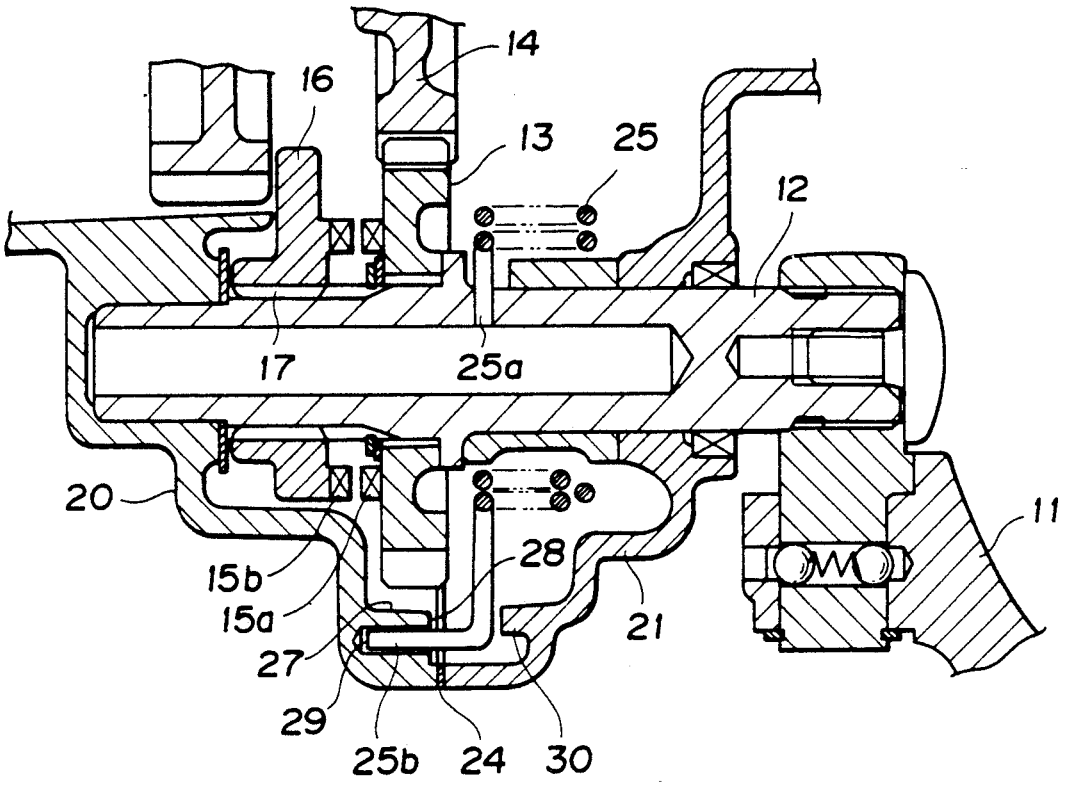
FIG. 1 is a side elevational section of a kick starting apparatus for a motorcycle according to this invention.

Referring to FIGS. 1 to 4 and more particularly to FIG. 1, the kick shaft 12 is mounted to the crank case 20 and the clutch case 21 which have mating faces to be coupled with each other with a gasket 24 interposed therebetween. The kick lever 11 is secured to the end of the kick shaft 12 on the outer side of the clutch case 21. On the kick shaft 12 are mounted in an opposing manner the kick drive gear 13 to be rotatable and the dog piece 16 through the helical spline 17. The dogs **15*a* and 15*b* are mounted on the side surfaces of the kick drive gear 13 and the dog piece 16** also in an opposing manner.

The kick drive gear 13 is always meshed with the kick idle gear 14, which is operatively connected to the crank shaft of the power transmission system of the motorcycle. When the kick shaft 12 is driven to be rotated by the operation of the kick lever 11 at the starting of the kick operation, the dog piece 16 is displaced axially towards the kick drive gear 13, i.e. rightwardly in the illustration, to thereby engage the dog **15*b* with the dog 15*a*. The engagement of the dogs 15*a* and 15*b* causes the kick drive gear 13 to rotate together with the dog piece 16, thus rotating the crank shaft. After the starting of the kick operation described above, the dog piece 16 is axially backwardly moved, i.e. leftwardly in the illustration, and the engagement between the dogs 15*a* and 15*b* and, hence, the kick lever 11 is released, whereby the kick lever 11 is returned to the initial position by the operation of a kick shaft return spring 25**.

Figure 2:
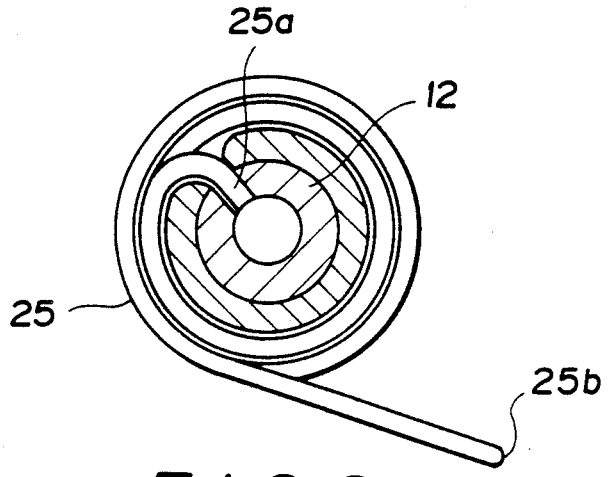
FIG. 2 is a front view of a kick shaft return spring in a state engaged with a kick shaft.

The kick shaft return spring 25 is formed as a coiled torsion spring mounted around the kick shaft 12 at a portion behind, i.e. rightward in the illustration, of the kick drive gear 13. The kick shaft return spring 25 has a main body disposed in the clutch case 21 and a free end **25*a* engaged with the kick shaft 12 as shown in FIG. 2 and a stationary end 25*b* bent at a substantially right angle so as to extend towards the crank shaft 20 in parallel to the kick shaft 12**.

Figure 3:
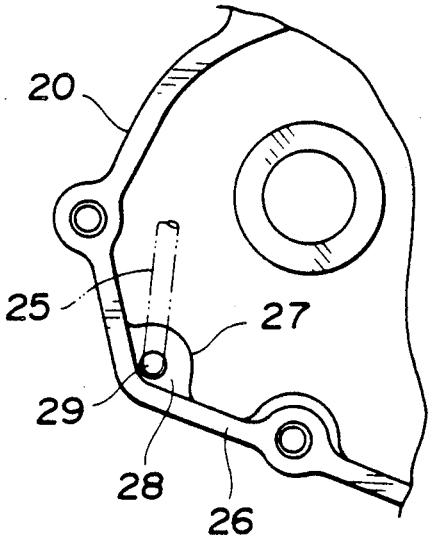
FIGS. 3 and 4 are end views in enlarged scales and partially broken of the crank case and the clutch case to be mated with each other.

As shown in FIG. 3, the crank case 20 is provided with a mating face 26 and an attachment boss 27 is formed at a portion directly inside and near the mating face 26. The attachment boss 27 has a top end surface 28 positioned slightly inward from the mating face 26. A hole 29 for receiving the end **25*b* of the kick shaft return spring 25 is formed in the attachment boss 27 so as to be substantially parallel to the kick shaft in a state shown in FIG. 1**.

Figure 4:
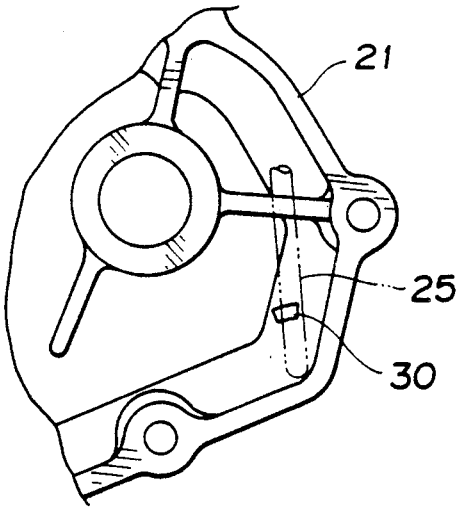

As shown in FIG. 4, the clutch case 21 is provided with a stopper portion 30 in form of a boss at a portion corresponding to the attachment boss 27 formed to the crank case 20 when the crank case 20 and the clutch case 21 are mated with each other. The crank case 20 and the clutch case 21 are mated and connected with each other so that the top end of the boss-shaped stopper 30 is positioned near the stationary end **25*b* of the kick shaft return spring 25 and abuts therewith to prevent the spring 25 from falling out from the engaging hole 29**.

In the manner described above, the stationary end **25*b* of the kick shaft return spring 25 can be firmly engaged with the hole 29 without falling out therefrom by the location of the boss-shaped stopper 30. The attachment boss 27 and the stopper 30 can be integrally casted with the crank case 20 and the clutch case 21, respectively, and the engaging hole 29** can be also integrally casted or easily drilled.

The location of the engaging hole 29 occupies a small space. No extra member or element is required for securing the kick shaft return spring 25, such as a fastening bolt, thus making light the spring assembly with reduced cost. Since the top surface of the attachment boss 27 is positioned slightly inward from the mating face of the crank case, the possibility of damaging the mating face of the crank case can be eliminated.

It is to be understood by those skilled in the art that this invention is not limited to the described embodiments and many other changes and modifications may be made without departing from the scope of the appended claim.

What is claimed is:

1. A kick starting apparatus for a motorcycle comprising:

a kick lever for starting a kick operation;

a kick shaft rotatably mounted to a crank case and a clutch case of the motorcycle when they are mated with each other with a gasket interposed therebetween;

a kick drive gear mounted to the kick shaft;

a kick idle gear mated with the kick drive gear and rotatably connected to a drive shaft of a power transmission system of the motorcycle; and a kick shaft return spring means elastically mounted to the kick shaft;

said crank case having an end mating face to be mated with an end mating face of the clutch case, the crank case being provided with an attachment boss disposed inside and near said mating face of the crank case, the boss being provided with a hole extending substantially in parallel to the kick shaft, said kick shaft return spring means having a main body accommodated in the clutch case when mated with the crank case, a first end firmly engaged with the kick shaft and a second end to be inserted into the hole formed in the attachment boss, and said clutch case being provided with a boss-shaped stopper portion corresponding to the attachment boss of the crank case when they are mated with each other for preventing the kick shaft return spring means from falling out from the hole formed in the case.

2. A kick starting apparatus according to claim 5, wherein said second end of said kick shaft return spring means is bent at substantially a right angle with respect to the main body thereof so as to extend in parallel to said kick shaft.

3. A kick starting apparatus according to claim 1, wherein said attachment boss is provided with an end surface positioned slightly inward from the mating face of said crank case.

4. A kick starting apparatus for a motorcycle having a crank case, and a clutch case connected to the crank case, the kick starting apparatus comprising: a kick shaft rotatably mounted to the connected together crank and clutch cases; a kick drive gear fixedly mounted on the kick shaft to undergo rotation therewith for transmitting a starting torque to a drive shaft of the motorcycle; a kick lever connected to the kick shaft for rotationally driving the kick shaft in a forward direction during a kick starting operation; kick shaft return spring means disposed within the clutch case for rotating the kick shaft in a reverse direction, the kick shaft return spring means having a first end firmly engaged with the kick shaft and a second end inserted into an opening in the crank case; and stopper means connected to the clutch case and extending interiorly thereof toward the crank case and abuttable with the kick shaft return spring means for preventing the second end of the kick shaft return spring means from falling out of the crank case opening.

5. A kick starting apparatus according to claim 4; wherein the stopper means comprises a stopper projection integral with the clutch case and projecting toward the crank case.

6. A kick starting apparatus according to claim 5; wherein the crank case opening extends substantially parallel to the kick shaft, and the second end of the kick shaft return spring means extends substantially parallel to the kick shaft and is inserted axially into the crank case opening.

7. A kick starting apparatus according to claim 4; wherein the crank case opening extends substantially parallel to the kick shaft, and the second end of the kick shaft return spring means extends substantially parallel to the kick shaft and is inserted axially into the crank case opening.

* * * * *